US005295680A

United States Patent [19]

Nishiguchi

[11] Patent Number: 5,295,680

[45] Date of Patent: Mar. 22, 1994

[54] PAPER STACKER APPARATUS AND METHOD

[75] Inventor: Hidehiro Nishiguchi, Kawasaki, Japan

[73] Assignee: Eastman Kodak Company, Rochester, N.Y.

[21] Appl. No.: 11,623

[22] Filed: Feb. 1, 1993

[30] Foreign Application Priority Data

May 25, 1992 [JP] Japan ..... 4-132445

[51] Int. Cl.[5] ..... B65H 29/00

[52] U.S. Cl. ..... 271/185; 271/198; 271/213

[58] Field of Search ..... 271/207, 213, 216, 177, 271/184, 185, 198; 414/794.4, 794.5

[56] References Cited

U.S. PATENT DOCUMENTS 2,815,210 12/1957 Weber et al. ..... 271/185
3,261,603 7/1966 Peterson et al. ..... 271/185
3,945,635 3/1976 Marin ..... 271/216

FOREIGN PATENT DOCUMENTS 0062357 3/1990 Japan ..... 271/207

*Primary Examiner*—H. Grant Skaggs
*Attorney, Agent, or Firm*—Raymond L. Owens

[57] ABSTRACT

A paper stacking apparatus enables documents emerging in a continuous flow from the exit of an image processing system to be stacked in the order in which the documents exit, even when the documents exit at irregular intervals. The paper stacking apparatus utilizes a conveyor belt which is divided into two transport segments. A first transport segment transports documents away from an exit of an image processing machine and drives a leading edge of each document onto an inclined stacking tray. A second transport segment, which slopes downwardly, pushes a trailing edge of each document onto the stacking tray.

7 Claims, 3 Drawing Sheets

PAPER STACKER APPARATUS AND METHOD

FIELD OF THE INVENTION

The present invention relates to a paper stacking apparatus, and, more particularly, to a paper stacking apparatus that stacks documents emerging from an image processing system or the like.

BACKGROUND OF THE INVENTION

Image processing systems such as copying machines, printers and image scanners are being required for high-speed processing of a growing quantities of information generated by modern society. An image processing system is usually equipped with an automatic document feeder to provide a continuous input of documents from a stack of such documents, and a paper stacker which stacks the processed documents as they exit from the system.

Referring now to FIGS. 1 and 2, there is shown a prior art paper stacking apparatus 20. The stacking apparatus 20 comprises a conveyor belt 22, support rollers 24 and a stacking tray 26. FIGS. 1 and 2 also show a portion of an image processing machine 40 with exit rollers 41 that feed documents 50 onto the paper stacking apparatus 20. The paper stacking apparatus 20 is coupled to the image processing machine 40. The conveyor belt 22 is driven in a direction shown by an arrow A by a conventional motor (not shown). The stacking tray 26 is attached to the paper stacking apparatus 20 at an angle to facilitate removal of the documents 50 after they are stacked. Stacked documents are designated with the numeral 50*a*.

The documents 50 which emerge from the exit rollers 41 are conveyed along the conveyor belt 22 at a speed that is slower than the speed at which the documents 50 exit the image processing machine 40. Because of this speed differential, the emerging documents 50 are conveyed with a leading edge of each the document 50 overlapping a trailing edge of the document 50 in front. The documents 50 thus conveyed are pushed up onto the stacking tray 26. As a result of the overlapping, the documents 50 are stacked up on the stacking tray 26 in the correct order.

In order to assure a proper overlapping of the documents 50, it is necessary to feed the documents 50 from the image processing machine 40 at a substantially constant rate and with a prescribed interval or space between the documents 50. If this prescribed interval is not maintained, a stream of the documents 50 exits with intermittent overlapping. This condition is shown in FIG. 2. One of the documents 50, designated as 50*b*, is shown in FIG. 2 being pushed up against the lower edge of the stacked documents 50*a* already on the stacking tray 26. When this condition occurs it is possible that the document 50*b* will be forced into the midst of the stacked documents 50*a*. When this occurs, the documents 50 are not stacked in the order in which they exited the image processing machine 40.

It is desirable therefore to provide a document stacking apparatus which can maintain a correct order of stacked documents emerging from an image processing machine when the documents are not overlapped.

SUMMARY OF THE INVENTION

The present invention is directed to a paper stacking apparatus which enables documents emerging in a continuous flow from the exit of an image processing system to be stacked in the order in which the documents exit, even when the documents exit at irregular intervals. The paper stacking apparatus utilizes a conveyor belt which is divided into two transport segments. A first transport segment transports documents away from an exit of an image processing machine and drives a leading edge of each document onto an inclined stacking tray. A second transport segment, which slopes downwardly, pushes a trailing edge of each document onto the stacking tray.

Viewed from one aspect, the present invention is directed to a paper stacking apparatus that stacks up a continuous flow of documents in the order in which the documents exit a system. The apparatus comprises a transport section provided with a first transport segment for transporting documents from the exit of the system and a second transport segment that slopes downward from the first transport segment. A document stacking tray is arranged toward the downstream end of the second transport segment at an angle thereto. Documents that have passed the first transport segment are stacked up on the stacking tray by a conveying force of the second transport segment.

Viewed from another aspect, the present invention is directed to a paper stacking apparatus that stacks up a continuous flow of documents in the order in which the documents exit a system. The apparatus comprises a transport section provided with a first transport segment for transporting the documents from the exit of the system and a second transport segment that slopes downward from the first transport segment. A feed roller is disposed in the vicinity of a connection between the first transport segment and the second transport segment. The feed roller feeds the documents transported by the first transport segment in a direction that is an extension of the line of the first transport segment. A document stacking tray is arranged toward a downstream end of the second transport segment at an angle thereto. Documents that have passed the feed roller are stacked up on the stacking tray by the conveying force of the second transport segment.

Viewed from still another aspect, the present invention is directed to a method for stacking a plurality of non overlapped documents emerging from a document processing machine. The method comprises the steps of conveying each of the documents away from the document processing machine in a substantially horizontal plane, sequentially interrupting a horizontal travel of a leading edge of each of the documents so that the leading edge of the document is tilted upwardly above the horizontal plane, sequentially producing a substantially simultaneous downward motion of a trailing edge of each of the documents below the horizontal plane whereby a central portion of the document is oriented so as to be intersected by the horizontal plane. The documents are thus sequentially stacked in the order in which they emerge from the document processing apparatus.

The invention will be better understood from the following detailed description taken in consideration with the accompanying drawings and claims.

The drawings are not necessarily to scale.

DETAILED DESCRIPTION

Figure 1:
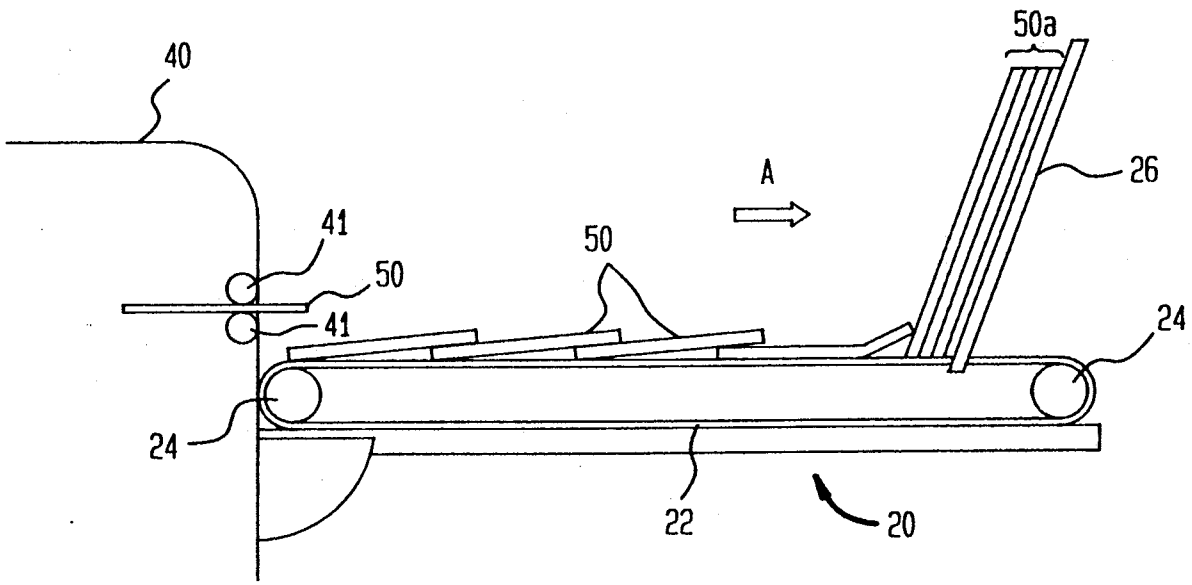
FIG. 1 (PRIOR ART)
FIG. 1 is an elevational view of a prior art paper stacking apparatus.
Figure 2:
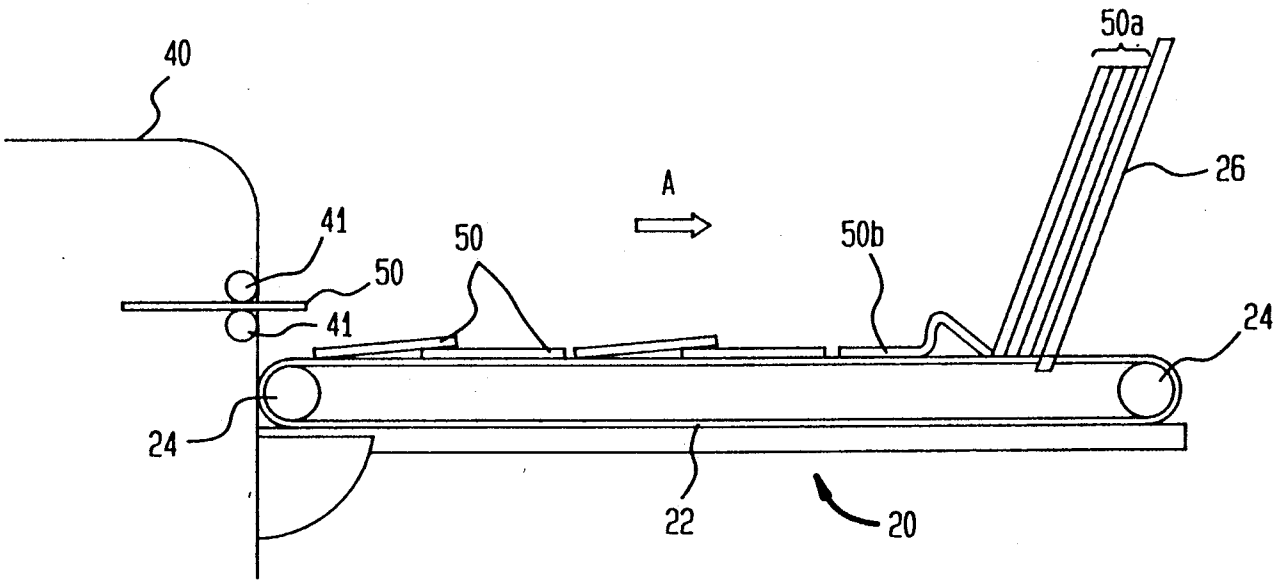
FIG. 2 (PRIOR ART)
FIG. 2 is a view of the paper stacking apparatus of FIG. 1 illustrating an undesirable feature of the apparatus.
Figure 3:
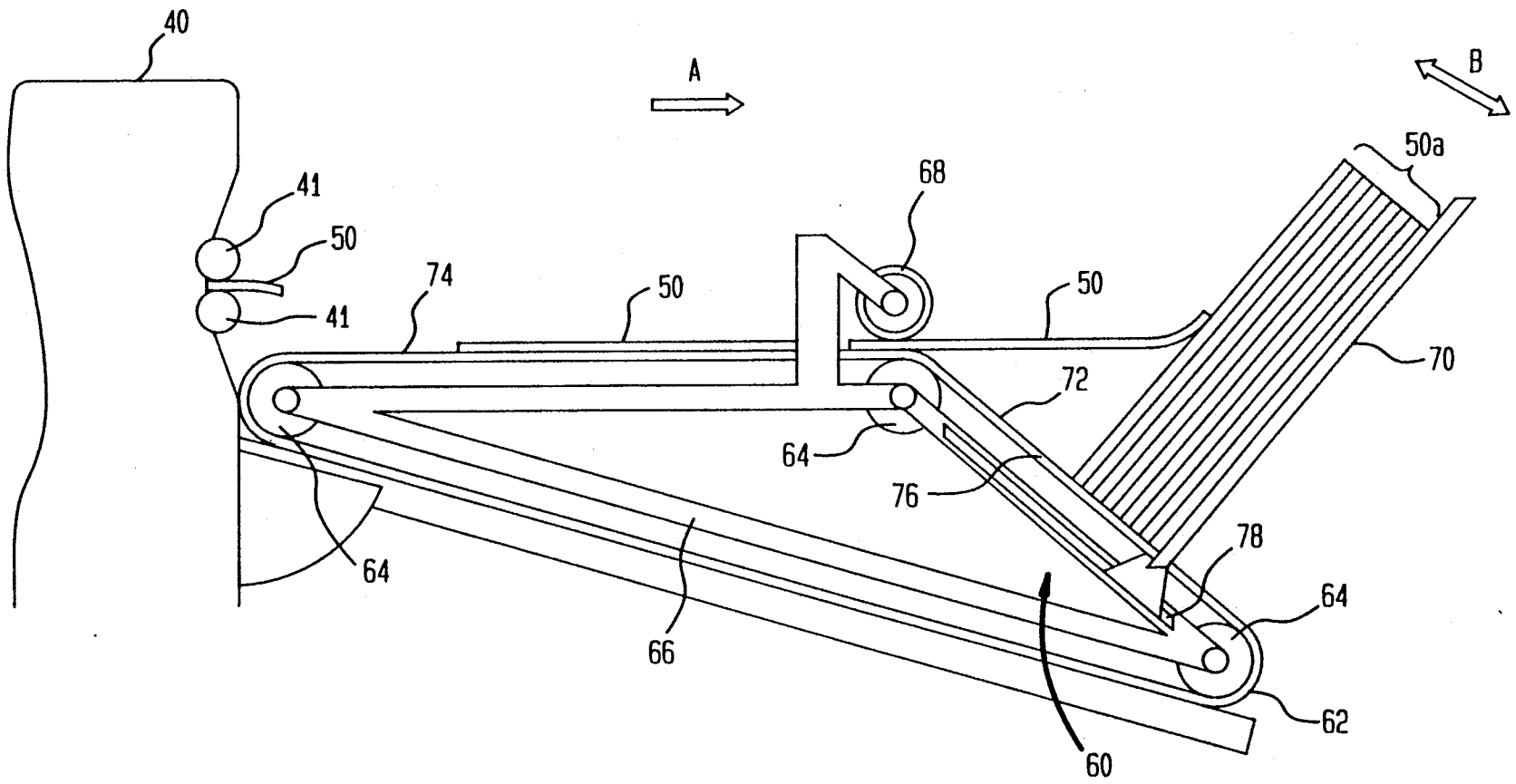
FIG. 3 is an elevational view of a paper stacking apparatus in accordance with the present invention.

Referring now to FIG. 3, there is shown one embodiment of a paper stacking apparatus 60 in accordance with the present invention. The paper stacking apparatus 60 comprises a conveyor belt 62, support rollers 64, a frame 66, a feed roller 68, and a stacking tray 70. An upper portion of the conveyor belt 62 operates as a transport section and is designated by the numeral 72. The transport section 72 comprises a first transport segment 74 and a second transport segment 76. The frame 66 is provided with a slide channel 78.

FIG. 3 also shows a portion of an image processing machine 40 with exit rollers 41 that feed documents 50 onto the paper stacking apparatus 60. The paper stacking apparatus 60 is coupled to the image processing machine 40. The conveyor belt 62 is driven in a direction shown by an arrow A by a conventional drive motor (not shown). The stacking tray 70 is attached to the paper stacking apparatus 60 at an angle to facilitate removal of the documents 50 after they are stacked. Stacked documents are designated with the numeral 50*a*.

To accomplish proper stacking, the paper stacking apparatus 60 utilizes the transport section 72 which is divided into the two transport segments 74 and 76. The transport section 72 comprises a portion of the conveyor belt 62 mounted on the support rollers 64 supported in the frame 66. The frame 66 is triangular in shape so that the first transport segment 74 extends contiguously from the exit rollers 41 in a substantially horizontal plane, and the second transport segment 76 inclines downward from an end of the first transport segment 74. The feed roller 68 is disposed in the vicinity of a connection between the first and second transport segments 74 and 76, and feeds the documents 50 in a direction that is an extension of the line of the first transport segment 74. The document stacking tray 70 is arranged toward the downstream end of the second transport segment 76 at an angle that accommodates sliding of each of the documents 50 onto a stack of the documents designated as 50*a*.

Thus, a continuous flow of the documents 50 emerging at irregular intervals from the exit rollers 41 of the image processing system 40 are transported along the first transport segment 74 of the transport section 72 in the direction indicated by arrow A. The feed roller 68 supports each of the documents 50 while it feeds the document 50 in a direction that is an extension of the line of the first transport segment 74. The feed roller 68 is not aligned exactly on the point at which the first transport segment 74 ends and the second transport segment 76 begins. Instead the feed roller 68 is disposed slightly toward an input end of the first transport segment 74 so that a leading edge of each of the documents 50 extending from the first transport segment 74 does not droop. In other words, the leading edge is precluded from following a path that is parallel to the second transport segment 76. In this way, each of the documents 50 is conveyed onto a central portion of the document stacking tray 70 or onto an inclined central surface portion of the document stack 50*a* already in the tray 70. The leading edge of the documents 50 thus transported come onto the document stacking tray 70 or document stack 50*a* and are stacked at an angle to the transporting surface by being pushed up over the surface of the tray 70 or document stack 50*a* by the conveying force of the second transport segment 76.

To ensure that the leading edge of each of the documents 50 fed by the feed roller 68 comes onto the central portion of the document stacking tray 70, the position of stacking tray 70 can be varied by being slid along the slide channel 78 formed in the frame 66 parallel to the second transport segment 76, as indicated by the double-headed arrow B. Specifically, the document stacking tray 70 is moved toward the feed roller 68 for documents having a short length and away from the feed roller 68 for documents having a long length.

It is to be appreciated and understood that the specific embodiments of the invention are merely illustrative of the general principles of the invention. Various modifications may be made by those skilled in the art which are consistent with the principles set forth. For example, while in the above embodiment a single conveyor belt is used that is bent downward partway along the belt to form the first and second transport segments, the segments can be made separate by using a combination of two conveyor belts.

What is claimed is:

1. A paper stacking apparatus that stacks up a continuous flow of documents in the order in which the documents exit a system, the paper stacking apparatus comprising:

a transport section provided with a first transport segment for transporting documents from the exit of the system and a second transport segment that slopes downward from the first transport segment; and a document stacking tray that is arranged toward a downstream end of the second transport segment at an angle thereto and on which documents that have passed the first transport segment are stacked up by a conveying force of the second transport segment.

2. The paper stacking apparatus of claim 1 wherein the stacking tray is positionable along the length of the second transport segment so as to facilitate the stacking of various lengths of the documents.

3. A paper stacking apparatus that stacks up a continuous flow of documents in the order in which the documents exit a system, the paper stacking apparatus comprising:

a transport section provided with a first transport segment for transporting the documents from the exit of the system and a second transport segment that slopes downward from the first transport segment;

a feed roller that is disposed in the vicinity of a connection between the first transport segment and the second transport segment which feed roller feeds the documents transported by the first transport segment in a direction that is an extension of the line of the first transport segment; and a document stacking tray that is arranged toward a downstream end of the second transport segment at an angle thereto and on which documents that have passed the feed roller are stacked up by a conveying force of the second transport segment.

4. The paper stacking apparatus of claim 3 wherein the stacking tray is positionable along the length of the second transport segment to facilitate the stacking of various lengths of the documents.

5. The paper stacking apparatus of claim 3 wherein the feed roller is positioned slightly away from a connection between the first and second transport segments toward an input end of the first transport segment whereby a leading edge of each of the documents is prevented from following a path that is parallel to the second transport segment.

6. A document stacker for stacking a plurality of non-overlapped documents emerging from a document processing machine comprising:

means for conveying each of the documents away from the document processing machine in a substantially horizontal plane;

means for sequentially interrupting a horizontal travel of a leading edge of each of the document such that the leading edge of the document is tilted upwardly above the horizontal plane; and means for sequentially producing a substantially simultaneous downward motion of a trailing edge of each of the documents below the horizontal plane such that a central portion of the document is oriented so as to be intersected by the horizontal plane such that the documents are sequentially stacked in the order in which they emerge from the document processing apparatus.

7. A method for stacking a plurality of nonoverlapped documents emerging from a document processing machine comprising the steps of:

conveying each of the documents away from the document processing machine in a substantially horizontal plane;

sequentially interrupting a horizontal travel of a leading edge of each of the document so that the leading edge of the document is tilted upwardly above the horizontal plane; and sequentially producing a substantially simultaneous downward motion of a trailing edge of each of the documents below the horizontal plane whereby a central portion of the document is oriented so as to be intersected by the horizontal plane such that the documents are sequentially stacked in the order in which they emerge from the document processing apparatus.

* * * * *